US010982878B2

(12) United States Patent
Hayashi et al.

(10) Patent No.: US 10,982,878 B2
(45) Date of Patent: Apr. 20, 2021

(54) INDOOR UNIT OF AIR-CONDITIONING APPARATUS

(71) Applicant: Mitsubishi Electric Corporation, Tokyo (JP)

(72) Inventors: Tsuyoshi Hayashi, Tokyo (JP); Kazuhito Kojima, Tokyo (JP); Hiroshi Omura, Tokyo (JP); Shuichi Kuroki, Tokyo (JP); Yohei Koyanagi, Tokyo (JP); Takuya Niimura, Tokyo (JP); Katsuya Ishigami, Tokyo (JP); Den Ozaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/483,446

(22) PCT Filed: Apr. 14, 2017

(86) PCT No.: PCT/JP2017/015346
§ 371 (c)(1),
(2) Date: Aug. 5, 2019

(87) PCT Pub. No.: WO2018/189894
PCT Pub. Date: Oct. 18, 2018

(65) Prior Publication Data
US 2020/0033024 A1 Jan. 30, 2020

(51) Int. Cl.
*F24F 13/22* (2006.01)
*F24F 1/0083* (2019.01)

(52) U.S. Cl.
CPC ..... *F24F 13/22* (2013.01); *F24F 1/0083* (2019.02); *F24F 2013/227* (2013.01)

(58) Field of Classification Search
CPC .... F24F 13/22; F24F 1/0083; F24F 2013/227; F24F 1/0057
See application file for complete search history.

(56) References Cited

U.S. PATENT DOCUMENTS

2010/0058793 A1* 3/2010 Miyamoto ..... F24F 13/222 62/291
2011/0011114 A1* 1/2011 Higa ..... B60H 1/3233 62/291
2015/0300681 A1* 10/2015 Hirakawa ..... F24F 1/0057 165/121

FOREIGN PATENT DOCUMENTS

CN 104024759 A 9/2014
JP S58-119111 U 8/1983
(Continued)

OTHER PUBLICATIONS

Office Action dated Aug. 5, 2020 issued in corresponding CN patent application No. 201780087842.7 (and English translation).
(Continued)

*Primary Examiner* — Emmanuel E Duke
(74) *Attorney, Agent, or Firm* — Posz Law Group, PLC

(57) ABSTRACT

An indoor unit of an air-conditioning apparatus includes: a heat exchanger which generates conditioned air by carrying out heat exchange between refrigerant and indoor air; and a drain pan disposed below a lower end of the heat exchanger to correct dew condensation water. The drain pan includes at a side portion thereof: a side dew receiving portion which receives dew condensation water; and a recessed portion disposed below the side dew receiving portion, the recessed portion being recessed toward an other side portion opposite to the side portion. A side face of the drain pan is provided with a heat insulating sheet covering an entire opening of the recessed portion.

4 Claims, 5 Drawing Sheets

(56) References Cited

FOREIGN PATENT DOCUMENTS

| | | | | |
|---|---|---|---|---|
| JP | H10-009604 | A | | 1/1998 |
| JP | 2006-125777 | A | | 5/2006 |
| JP | 2010121872 | A | * | 1/2010 |
| JP | 2010-121872 | A | | 6/2010 |

OTHER PUBLICATIONS

Extended European Search Report dated Feb. 26, 2020 for the corresponding EP application No. 17890846.3.
International Search Report of the International Searching Authority dated Jun. 20, 2017 for the corresponding international application No. PCT/JP2017/015346 (and English translation).
Office Action dated Feb. 22, 2021 issued in corresponding CN patent application No. 201780087842.7 (and English translation).

* cited by examiner

INDOOR UNIT OF AIR-CONDITIONING APPARATUS

CROSS REFERENCE TO RELATED APPLICATION

This application is a U.S. national stage application of International Application No. PCT/JP2017/015346, filed on Apr. 14, 2017, the contents of which are incorporated herein by reference.

TECHNICAL FIELD

The present invention relates to an indoor unit of an air-conditioning apparatus, more specifically, to a countermeasure against dew condensation on a drain pan.

BACKGROUND

Conventionally, countermeasures against dew condensation have been applied to a drain pan installed in an indoor unit of an air-conditioning apparatus (for example, see Patent Literature 1).

Patent Literature 1 discloses a countermeasure against dew condensation on a drain pan. In the countermeasure, the drain pan is made to have a hollow cross section in its central portion, and a groove is formed at a lowermost section in the central portion. This produces a heat insulating effect on the central portion of the drain pan, preventing dew condensation on the drain pan.

PATENT LITERATURE

Patent Literature 1: Japanese Unexamined Utility Model Application Publication No. S58-119111

In Patent Literature 1, while a countermeasure against dew condensation is applied to the central portion of the drain pan, it is not applied to a side portion of the drain pan. This gives rise to a problem in that dew condensation easily occurs at the side portion of the drain pan.

SUMMARY

The present invention has been made to solve the above problem, and aims to provide an indoor unit of an air-conditioning apparatus that is capable of preventing dew condensation on a side portion of the drain pan.

An indoor unit of an air-conditioning apparatus according to an embodiment of the present invention includes: a heat exchanger configured to generate conditioned air by carrying out heat exchange between a refrigerant and indoor air; and a drain pan disposed below a lower end of the heat exchanger to collect dew condensation water. The drain pan includes at a side portion thereof: a side dew receiving portion configured to receive dew condensation water; and a recessed portion disposed below the side dew receiving portion, the recessed portion being recessed toward an other side portion opposite to the side portion. A side face of the drain pan is provided with a heat insulating sheet covering an entire opening of the recessed portion.

In the indoor unit of the air-conditioning apparatus according to an embodiment of the present invention, the drain pan includes a recessed portion disposed below a side dew receiving portion, and a heat insulating sheet provided at a side face of the drain pan. This produces a high heat insulating effect on the side portion of the drain pan, preventing dew condensation on the side portion of the drain pan.

DETAILED DESCRIPTION

Figure 1:
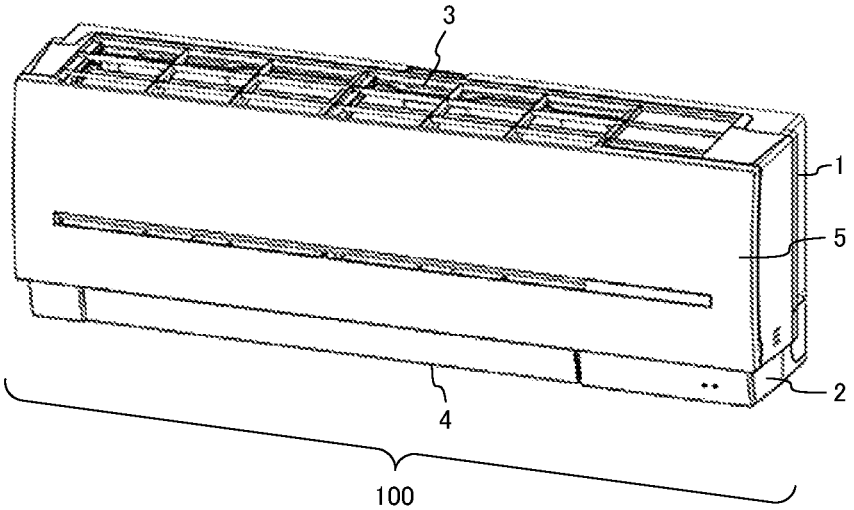
FIG. 1 is an external perspective view of an indoor unit of an air-conditioning apparatus according to an embodiment of the present invention as viewed from a front side.

An embodiment of the present invention will be described hereinafter with reference to the drawings. It should be noted that the present invention is not limited to the embodiment explained below. It also should be noted that a relationship in size between components as shown in the drawings may be different from the actual one.

EMBODIMENT

Figure 2:
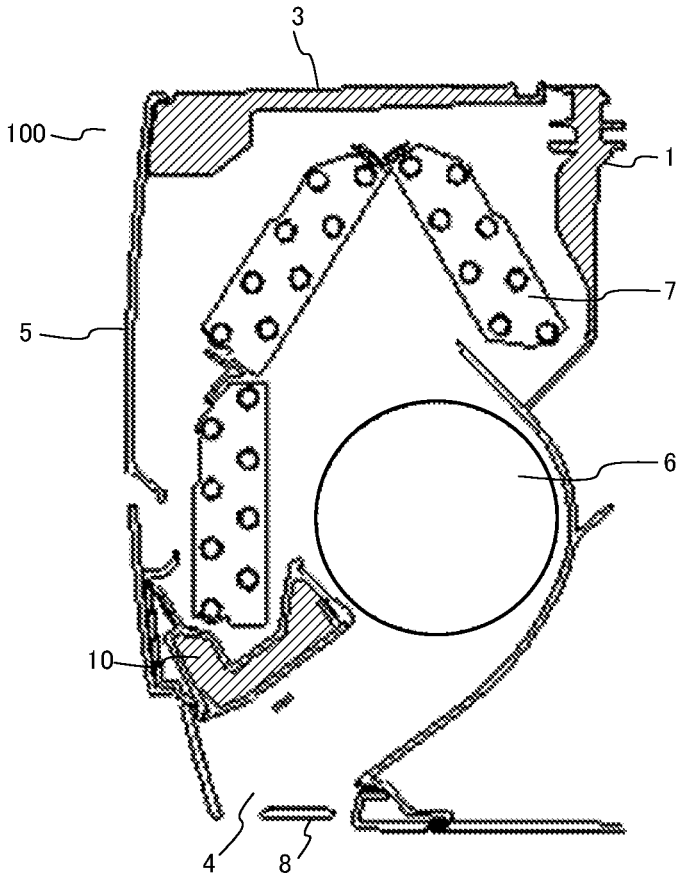
FIG. 2 is a schematic vertical cross-sectional view of the indoor unit of the air-conditioning apparatus according to the embodiment of the present invention as viewed from a right side.

FIG. 1 is an external perspective view of an indoor unit 100 of an air-conditioning apparatus according to the embodiment of the present invention as viewed from a front side. FIG. 2 is a schematic vertical cross-sectional view of the indoor unit 100 of the air-conditioning apparatus according to the embodiment of the present invention as viewed from a right side.

Hereinafter, a construction of the indoor unit 100 of the air-conditioning apparatus will be explained with reference to FIGS. 1 and 2.

In the following explanation, terms indicating directions such as "up", "down", "right" and "left" are used as necessary to facilitate understanding. However, these terms are used for explanatory purposes and are not intended to limit the present invention. Also, with respect to the embodiment, the terms "up", "down", "right" and "left" are used to indicate respective directions when the indoor unit 100 of the air-conditioning apparatus is viewed from the front side.

The indoor unit 100 of the air-conditioning apparatus according to the embodiment supplies conditioned air to an air-conditioned area, such as a room, by using a refrigeration cycle circulating refrigerant. The embodiment is explained by referring to by way of example the case where the indoor unit 100 is a wall-mounted type indoor unit to be mounted on a wall of an air-conditioned area.

As shown in FIG. 1, the indoor unit 100 includes a rear case 1 mounted on a wall, and a housing 2 attached to a front surface of the rear case 1. The housing 2 has an air inlet 3 for mainly taking indoor air into the housing 2, and an air outlet 4 for supplying conditioned air to the air-conditioned area. Additionally, a front design panel 5 is openably attached to a front surface of the housing 2.

As shown in FIG. 2, the indoor unit 100 accommodates therein an air-sending fan 6 configured to take in indoor air from the air inlet 3 and blowing conditioned air through the air outlet 4, and a heat exchanger 7 which is disposed on an air path between the air inlet 3 and the air outlet 4 with its longitudinal direction extending along a left-right direction, and which is configured to generate conditioned air by carrying out heat exchange between a refrigerant and the indoor air. These components define an air communication path in the housing 2. The indoor unit 100 further includes therein an electric component box (not shown) which accommodates a circuit board and other components, and a drain pan 10 disposed below a lower end of the heat exchanger 7 to collect dew condensation water from the heat exchanger 7. The drain pan 10 will be described later in detail.

The air inlet 3 is formed in an upper portion of the housing 2 as an opening. The air outlet 4 is formed in a lower portion of the housing 2 as another opening. The air-sending fan 6 is disposed downstream of the air inlet 3 and upstream of the heat exchanger 7, and is an axial fan or a mixed flow fan, for example. The heat exchanger 7 is inverted V-shaped or A-shaped in vertical cross section, and is disposed on the leeward of the air-sending fan 6. The heat exchanger 7 may be a fin tube-type heat exchanger, for example. The air inlet 3 is provided with a finger guard and a filter (not shown). Further, the air outlet 4 is provided with a vertical wind direction adjusting plate 8 for controlling a blowing direction of air flow.

It is not necessarily set that the heat exchanger 7 is strictly inverted V-shaped or A-shaped in vertical cross section. Also, the air-sending fan 6 is not limited to one disposed upstream of the heat exchanger 7. A cross-flow fan disposed downstream of the heat exchanger 7 may be applied as the air-sending fan 6.

Next, air flow inside the indoor unit 100 will be briefly explained.

First, indoor air is sent by the air-sending fan 6 into the indoor unit 100 through the air inlet 3 formed in the upper portion of the housing 2. At this time, dust contained in the indoor air is removed by the filter (not shown). While passing through the heat exchanger 7, this indoor air is heated or cooled by the refrigerant inside the heat exchanger 7 to become conditioned air. The conditioned air is then blown out to the outside of the indoor unit 100, namely a to-be-air-conditioned area, through the air outlet 4 formed in the lower portion of the housing 2.

Figure 3:
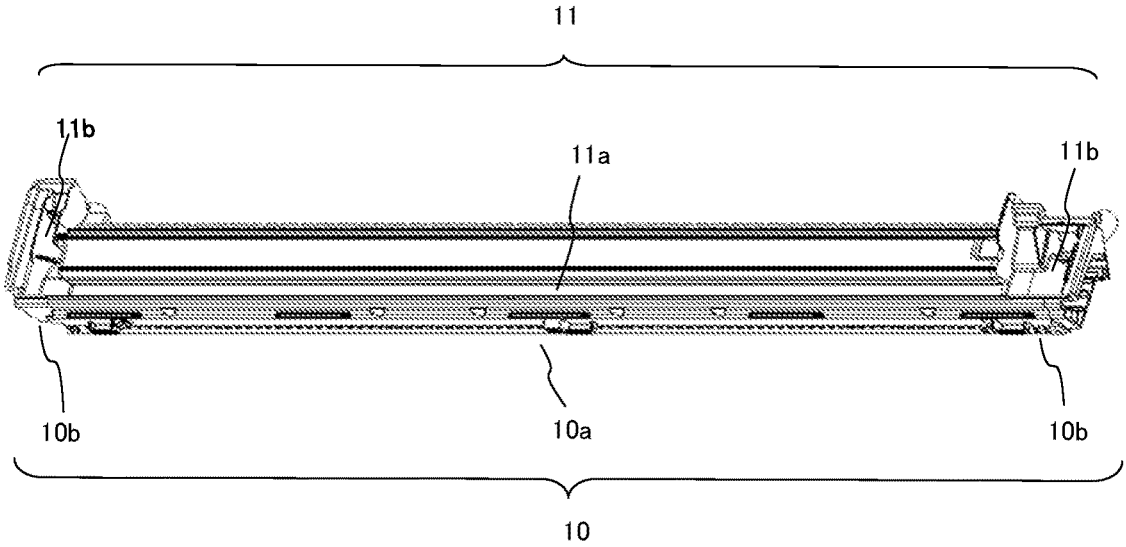
FIG. 3 is a perspective view of a drain pan of the indoor unit of the air-conditioning apparatus according to the embodiment of the present invention as viewed from the front side.
Figure 4:
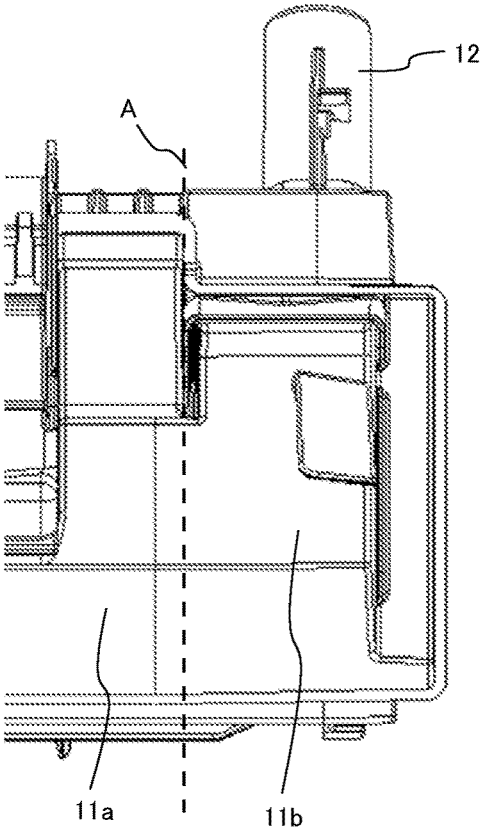
FIG. 4 is a plan view of a right side portion of the drain pan as shown in FIG. 3.
Figure 5:
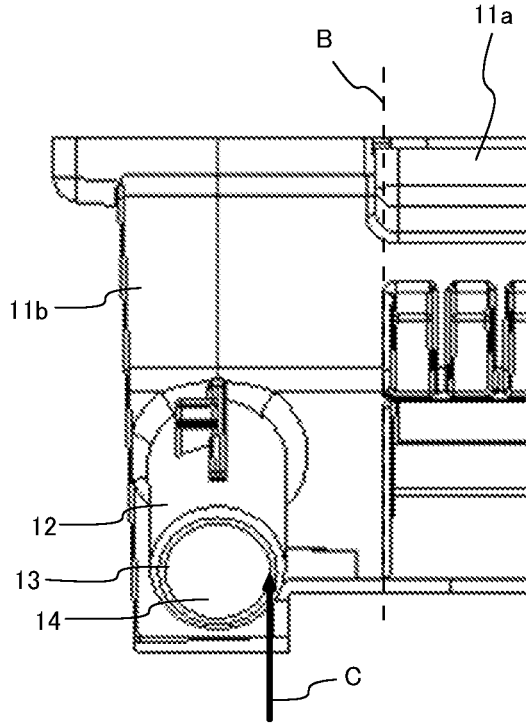
FIG. 5 is a back view of the right side portion of the drain pan as shown in FIG. 3.
Figure 6:
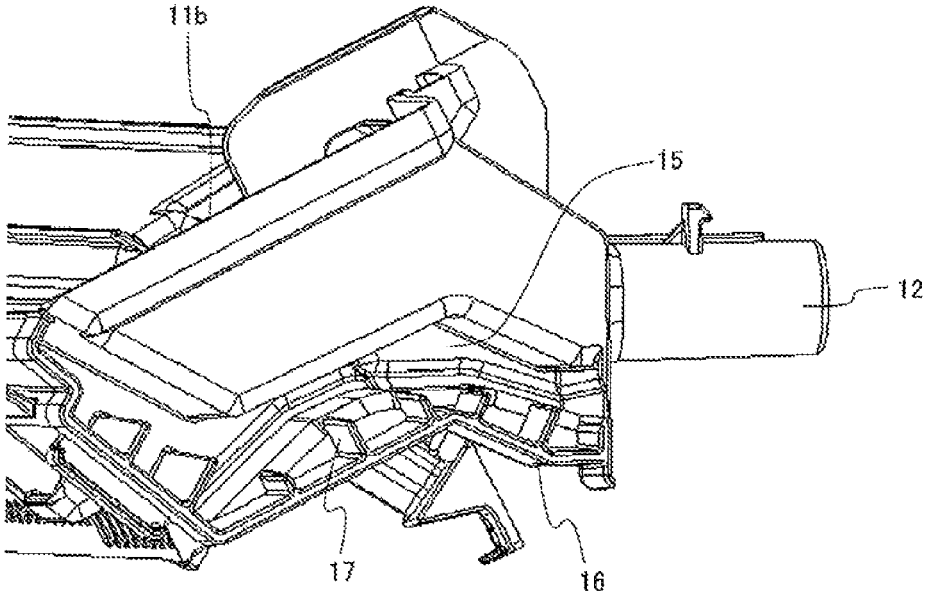
FIG. 6 is a perspective view of the right side portion of the drain pan as shown in FIG. 3 as viewed from the front side.
Figure 7:
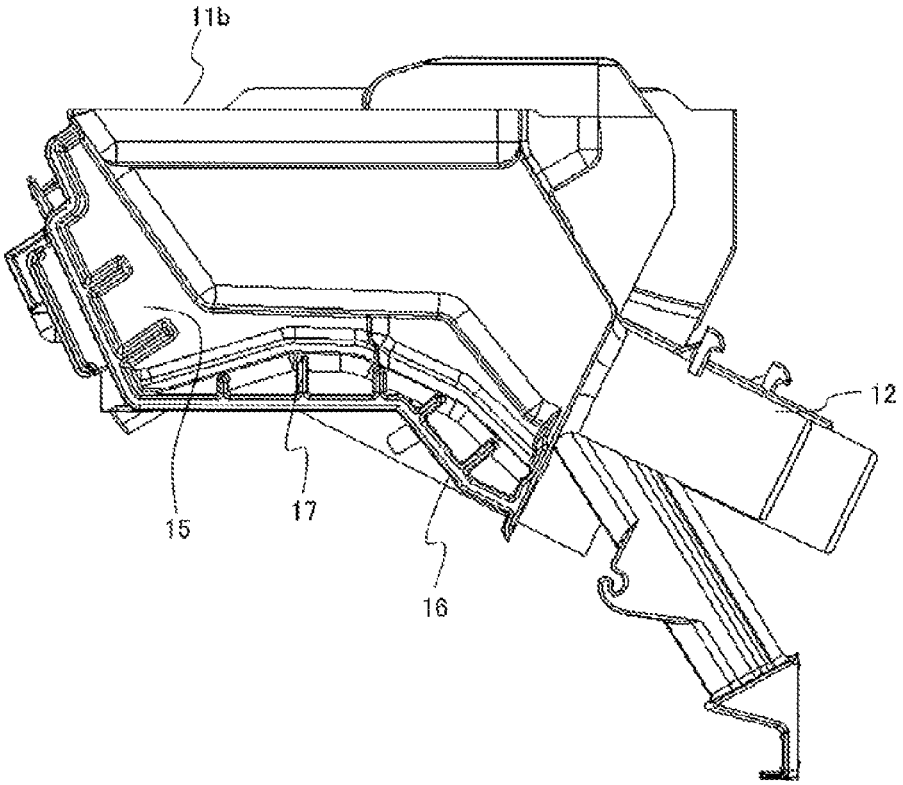
FIG. 7 is a side view of the right side portion of the drain pan as shown in FIG. 3.

FIG. 3 is a perspective view of the drain pan 10 of the indoor unit 100 of the air-conditioning apparatus according to the embodiment of the present invention as viewed from the front side. FIG. 4 is a plan view of a right side portion 10*b* of the drain pan 10 shown in FIG. 3. FIG. 5 is a back view of the right side portion 10*b* of the drain pan 10 as shown in FIG. 3. FIG. 6 is a perspective view of the right side portion 10*b* of the drain pan 10 as shown in FIG. 3 as viewed from the front side. FIG. 7 is a side view of the right side portion 10*b* of the drain pan 10 as shown in FIG. 3. Broken lines A and B respectively shown in FIGS. 4 and 5 each indicate a boundary between a central dew receiving portion 11*a* and a side dew receiving portion 11*b*. An arrow C in FIG. 5 will be described later.

The drain pan 10 is disposed below the lower end of the heat exchanger 7, and collects dew condensation water adhering to the heat exchanger 7 during cooling operation of the indoor unit 100. The drain pan 10 has a configuration as shown in FIGS. 3 to 7.

As shown in FIG. 3, the drain pan 10 includes a dew receiving unit 11 for receiving dew condensation water. The dew receiving unit 11 comprises: the central dew receiving portion 11*a*, which is located on a central portion 10*a* of the drain pan 10; and the side dew receiving portion 11*b*, which is located on each side portion 10*b* of the drain pan 10. Further, as shown in FIGS. 4 and 5, a connecting portion 12 to which a drain hose (not shown) is to be connected is provided on a rear side of the side dew receiving portion 11*b*). The connecting portion 12 includes a cylindrical inner wall 13 and a drain port 14 defined by the surrounding inner wall 13.

A flow path extending in the left-right direction and communicating with the side dew receiving portion 11*b* is formed on an upper surface of the central dew receiving portion 11*a*. Additionally, a flow path extending in a front-back direction and communicating with the drain port 14 is formed on an upper surface of the side dew receiving portion 11*b*.

When installed, the indoor unit 100 is inclined with respect to a horizontal direction. Accordingly, the drain pan 10 is also inclined with respect to the horizontal direction. More specifically, upper surfaces of the central dew receiving portion 11*a* and the side dew receiving portion 11*b* are inclined in a direction in which the indoor unit 100 is inclined, and also toward the rear side.

Thus, dew condensation water adhering to the heat exchanger 7 during cooling operation of the indoor unit 100 drops on the upper surface of the central dew receiving portion 11*a*, moves to the upper surface of the side dew receiving portion 11*b* inclined downward with respect to the horizontal direction, and is then drained to the outside of the indoor unit 100 from the drain port 14 of the connecting portion 12 through the drain hose.

Further, as shown in FIG. 3, the drain pan 10 includes, at the side portion 10*b* thereof, a recessed portion 15 below the side dew receiving portion 11*b*. The recessed portion 15 is recessed toward the side portion 10*b* on the opposite side. The recessed portion 15 includes a surrounding wall 16. The surrounding wall 16 covers a lower face of the side dew receiving portion 11*b*, with space provided between them. The surrounding wall 16 includes plural ribs 17 protruding into the space.

Figure 8:
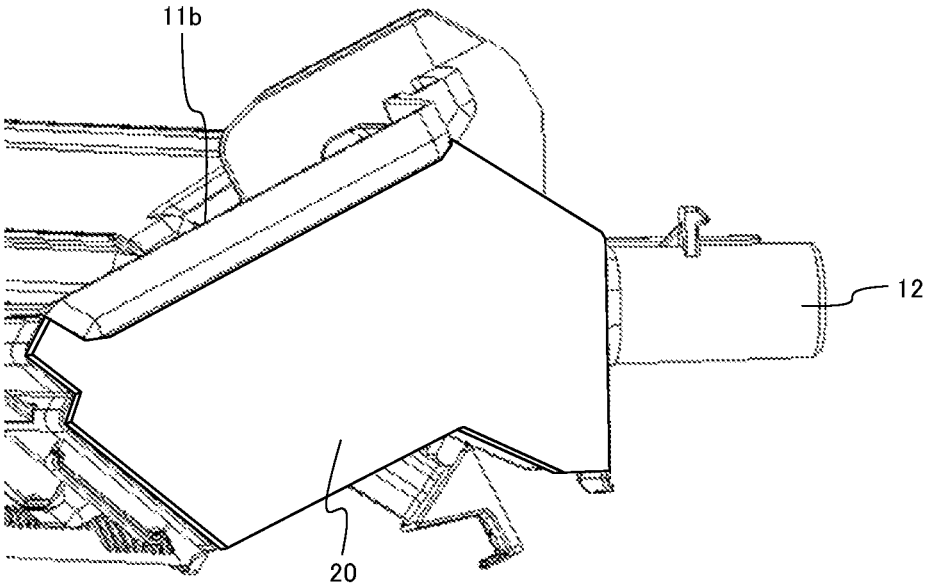
FIG. 8 illustrates a state where a heat insulating sheet is attached to a right side surface of the drain pan as shown in FIG. 4.
Figure 9:
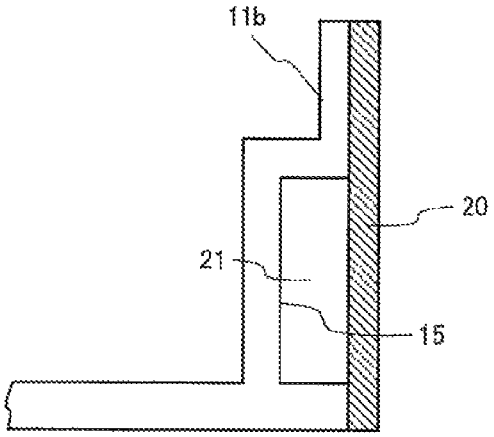
FIG. 9 is a schematic view for explaining an air layer formed inside the right side portion of the drain pan as shown in FIG. 4.

FIG. 8 illustrates a state where a heat insulating sheet 20 is adhered to the right side face of the drain pan 10 as shown in FIG. 4. FIG. 9 is a schematic view for explaining an air layer 21 formed inside the right side portion 10*b* of the drain pan 10 as shown in FIG. 4.

As shown in FIG. 8, a heat insulating sheet 20, which is a heat insulating material, is attached to the side face of the drain pan 10 in such a manner as to cover an entire opening of the recessed portion 15. As a result, a hollow air layer 21 is formed between the recessed portion 15 and the heat insulating sheet 20, as shown in FIG. 9. Since thermal conductivity of air is extremely low, the air layer 21 functions as a heat insulating material having a high heat insulating effect. Thus, by virtue of the heat insulating sheet 20 and the air layer 21, a high heat insulating effect can be produced.

After collected by the drain pan 10, dew condensation water always passes through the side dew receiving portion 11*b* when it is drained from the drain port 14. For this reason, dew condensation water tends to accumulate on the side dew receiving portion 11*b*. Further, dew condensation water flows on the side dew receiving portion 11*b* more slowly than on the central dew receiving portion 11*a*, as a result of which dew condensation easily occurs at the side dew receiving portion 11*b*. It is therefore necessary to take thorough measures dew condensation on the side dew receiving portion 11*b*. However, because of the heat insulating sheet 20 and the air layer 21, a high heat insulating effect can be produced at the side dew receiving portion 11*b*, and dew condensation can thus be prevented from occurring at the side dew receiving portion 11*b*.

Further, the heat insulating sheet 20 is made of polystyrene foam, which is commercially available as an inexpensive resin-based heat insulating material. The heat insulating sheet 20 originally has a sheet shape, and is cut according to a shape of the side face of the side dew receiving portion 11*b*. Polystyrene foam is soft and easy to cut with a tool such as scissors and a cutter. Further, the heat insulating sheet 20 has an adhesion surface on at least one side thereof.

Thus, since the heat insulating sheet 20 is used as a heat insulating material for the side dew receiving portion 11*b*, it eliminates the need for die casting, which has previously been required, and also can be more easily attached to the side face of the drain pan 10. This can reduce manufacturing costs.

Further, the plural ribs 17 are provided at the surrounding wall 16 of the recessed portion 15, such that adhesion areas between the heat insulating sheet 20 and the side face of the drain pan 10 are increased when the heat insulating sheet 20 is attached to the side face of the drain pan 10. As a result, the heat insulating sheet 20 can be more easily attached to the side face of the drain pan 10.

Additionally, the recessed portion 15 is recessed at least up to a position at the inner wall 13 of the connecting portion 12 that is most proximal to the central dew receiving portion 11*a* (a position indicated by the arrow C in FIG. 5).

This is to form the air layer 21 in an entire lower part of the drain port 14, on which dew condensation most easily occurs. It should be noted that the recessed portion 15 may be recessed at most up to the boundary between the central dew receiving portion 11*a* and the side dew receiving portion 11*b*. This is because the central dew receiving portion 11*a* does not require the air layer 21 for heat insulation since dew condensation water flows faster on the central dew receiving portion 11*a* than on the side dew receiving portion 11*b* and thus sufficient heat insulation for the central dew receiving portion 11*a* can be ensured by means such as affixing a heat insulating material (not shown) to a lower surface of the central dew receiving portion 11*a*.

As explained above, the indoor unit 100 of the air-conditioning apparatus according to the embodiment includes: the heat exchanger 7 configured to conditioned air by carrying out heat exchange between refrigerant and indoor air; and the drain pan 10 disposed below the lower end of the heat exchanger 7 to collect dew condensation water. The drain pan 10 includes, at the side portion 10*b* thereof, the side dew receiving portion 11*b* for receiving dew condensation water, and the recessed portion 15 disposed below the side dew receiving portion 11*b* and recessed toward the other side portion 10*b* on the opposite side of the side portion 10*b*. The heat insulating sheet 20 is provided at the side face of the drain pan 10 in such a manner as to cover the entire opening of the recessed portion 15.

The indoor unit 100 of the air-conditioning apparatus according to the embodiment includes the recessed portion 15 disposed below the side dew receiving portion 11*b* of the drain pan 10, and the heat insulating sheet 20 provided at the side face of the drain pan 10. This can produce a high heat insulating effect on the side dew receiving portion 11*b*, preventing dew condensation on the side dew receiving portion 11*b*.

Further, the indoor unit 100 of the air-conditioning apparatus according to the embodiment includes, at the side dew receiving portion 11*b*, the connecting portion 12 having the inner wall 13 defining the drain port 14. The recessed portion 15 is recessed at least up to a position at the inner wall 13 that is most proximal to the central dew receiving portion 11*a*.

In the indoor unit 100 of the air-conditioning apparatus according to the embodiment, the air layer 21 is formed in the entire lower part of the drain port 14, on which dew condensation most easily occurs. This can produce a high heat insulating effect on the side dew receiving portion 11*b*.

Further, in the indoor unit 100 of the air-conditioning apparatus according to the embodiment, the recessed portion 15 includes the surrounding wall 16 covering the lower face of the side dew receiving portion 11*b*, with space provided between them. The surrounding wall 16 includes the plural ribs 17 protruding into the space.

In the indoor unit 100 of the air-conditioning apparatus according to the embodiment, because of the plural ribs 17, adhesion areas between the heat insulating sheet 20 and the side face of the drain pan 10 are increased when the heat insulating sheet 20 is adhered to the side face of the drain pan 10. As a result, the heat insulating sheet 20 can be easily attached to the side face of the drain pan 10.

The invention claimed is:

1. An indoor unit of an air-conditioning apparatus comprising:

a heat exchanger configured to generate conditioned air by carrying out heat exchange between refrigerant and indoor air; and a drain pan disposed below a lower end of the heat exchanger to correct dew condensation water, wherein the drain pan includes at a side portion thereof:

a side dew receiving portion configured to receive dew condensation water; and a recessed portion disposed below the side dew receiving portion, the recessed portion being recessed toward an other side portion opposite to the side portion, and wherein a side face of the drain pan is provided with a heat insulating sheet covering an entire opening of the recessed portion.

2. The indoor unit of the air-conditioning apparatus of claim 1, wherein the drain pan includes, at a central portion thereof, a central dew receiving portion configured to receive dew condensation water, the side dew receiving portion includes a connecting portion having an inner wall, the inner wall defining a drain port, and the recessed portion is recessed at least up to a position at the inner wall, the position being most proximal to the central dew receiving portion.

3. The indoor unit of the air-conditioning apparatus of claim 2, wherein the recessed portion includes a surrounding wall which covers a lower face of the side dew receiving portion, with space provided between the surrounding wall and the lower face, and the surrounding wall includes a plurality of ribs protruding into the space.

4. The indoor unit of the air-conditioning apparatus of claim 1, wherein the recessed portion includes a surrounding wall which covers a lower face of the side dew receiving portion, with space provided between the surrounding wall and the lower face, and the surrounding wall includes a plurality of ribs protruding into the space.

* * * * *